US011053451B2

(12) United States Patent
Tanimura et al.

(10) Patent No.: US 11,053,451 B2
(45) Date of Patent: Jul. 6, 2021

(54) LUBRICANT COMPOSITION FOR A SPEED REDUCER, AND SPEED REDUCER

(71) Applicants: Kyodo Yushi Co., Ltd., Fujisawa (JP); Nabtesco Corporation, Tokyo (JP)

(72) Inventors: Ko Tanimura, Toyota (JP); Ryosuke Ichimura, Kawasaki (JP); Ryosuke Saito, Fujisawa (JP); Hongyou Wang, Tsu (JP); Takahide Kumagai, Tsu (JP)

(73) Assignees: KYODO YUSHI CO., LTD., Fujisawa (JP); NABTESCO CORPORATION, Tokyo (JP)

( * ) Notice: Subject to any disclaimer, the term of this patent is extended or adjusted under 35 U.S.C. 154(b) by 86 days.

(21) Appl. No.: 16/487,137

(22) PCT Filed: Feb. 20, 2018

(86) PCT No.: PCT/JP2018/005839

§ 371 (c)(1),
(2) Date: Aug. 20, 2019

(87) PCT Pub. No.: WO2018/155395

PCT Pub. Date: Aug. 30, 2018

(65) Prior Publication Data

US 2021/0087491 A1 Mar. 25, 2021

(30) Foreign Application Priority Data

Feb. 21, 2017 (JP) ..... JP2017-030091

(51) Int. Cl.

| | |
|---|---|
| ***C10M 169/04*** | (2006.01) |
| ***C10M 107/02*** | (2006.01) |
| ***C10M 129/10*** | (2006.01) |
| ***C10M 129/54*** | (2006.01) |
| ***C10M 129/72*** | (2006.01) |
| ***C10M 135/10*** | (2006.01) |
| ***C10M 135/36*** | (2006.01) |
| *C10N 10/04* | (2006.01) |
| *C10N 20/02* | (2006.01) |
| *C10N 30/02* | (2006.01) |
| *C10N 30/06* | (2006.01) |
| *C10N 30/08* | (2006.01) |
| *C10N 30/10* | (2006.01) |
| *C10N 40/04* | (2006.01) |

(52) U.S. Cl.

CPC ..... *C10M 169/04* (2013.01); *C10M 107/02* (2013.01); *C10M 129/10* (2013.01); *C10M 129/54* (2013.01); *C10M 129/72* (2013.01); *C10M 135/10* (2013.01); *C10M 135/36* (2013.01); *C10M 2205/003* (2013.01); *C10M 2207/028* (2013.01); *C10M 2207/144* (2013.01); *C10M 2207/262* (2013.01); *C10M 2219/044* (2013.01); *C10M 2219/046* (2013.01); *C10M 2219/106* (2013.01); *C10N 2010/04* (2013.01); *C10N 2020/02* (2013.01); *C10N 2030/02* (2013.01); *C10N 2030/06* (2013.01); *C10N 2030/08* (2013.01); *C10N 2030/10* (2013.01); *C10N 2040/04* (2013.01)

(58) Field of Classification Search

CPC ..... C10M 169/044; C10M 117/04; C10M 137/10; C10M 2203/024; C10M 2205/022; C10M 2205/024; C10M 2219/066; C10M 2219/046; C10M 2207/1265; C10M 2223/045; C10M 2203/003; C10M 2219/044; C10N 2040/04; C10N 2050/10; C10N 2010/04

See application file for complete search history.

(56) References Cited

U.S. PATENT DOCUMENTS 8,039,423 B2 * 10/2011 Kitahata ..... C10M 169/06 508/390
2005/0025975 A1 2/2005 Okamoto et al.
2008/0276755 A1 11/2008 Okamoto et al.
(Continued)

FOREIGN PATENT DOCUMENTS

EP 0 719 851 A2 7/1996
EP 1087008 A1 3/2001
(Continued)

OTHER PUBLICATIONS

International Search Report (PCT/ISA/210) and translation and Written Opinion (PCT/ISA/237) dated Apr. 3, 2018, by the Japanese Patent Office as the International Searching Authority for International Application No. PCT/JP2018/005839.

Extended European Search Report dated Nov. 18, 2020, issued by the European Patent Office in corresponding European Application No. 18756782.1-1104, (8 pages).

*Primary Examiner* — Vishal V Vasisth

(74) *Attorney, Agent, or Firm* — Buchanan, Ingersoll & Rooney PC

(57) ABSTRACT

The invention provides a lubricant composition for an eccentric oscillating planetary gear type speed reducer comprising the following components (a) to (d): (a) a base oil containing a synthetic oil; (b) at least one calcium salt selected from the group consisting of calcium salts of petroleum sulfonic acids, calcium salts of alkyl aromatic sulfonic acids, calcium salts of salicylates, calcium salts of phenates, calcium salts of oxidized waxes, overbased calcium salts of petroleum sulfonic acids, overbased calcium salts of alkyl aromatic sulfonic acids, overbased calcium salts of salicylates, overbased calcium salts of phenates, and overbased calcium salts of oxidized waxes; (c) an antioxidant; and (d) a glycerin fatty acid ester.

7 Claims, No Drawings

(56) References Cited

U.S. PATENT DOCUMENTS

| | | | | |
|---|---|---|---|---|
| 2012/0129744 | A1 | 5/2012 | Mcdougall | |
| 2013/0331307 | A1* | 12/2013 | Meijer | C10M 169/06 508/534 |
| 2015/0175923 | A1 | 6/2015 | Gaal et al. | |
| 2015/0252283 | A1* | 9/2015 | Sekiguchi | C10M 169/06 508/179 |

FOREIGN PATENT DOCUMENTS

| | | | |
|---|---|---|---|
| JP | 2004339411 | A | 12/2004 |
| JP | 2005061610 | A | 3/2005 |
| JP | 2005133791 | A | 5/2005 |
| JP | 2008143927 | A | 6/2008 |
| JP | 2010024355 | A | 2/2010 |
| JP | 2013543047 | A | 11/2013 |
| WO | 2013/037932 | A1 | 3/2013 |

* cited by examiner

LUBRICANT COMPOSITION FOR A SPEED REDUCER, AND SPEED REDUCER

This application is a 371 of PCT/JP2018/005839, filed Feb. 20, 2018.

TECHNICAL FIELD

The present invention relates to a lubricant composition used in an eccentric oscillating planetary gear type speed reducer, and an eccentric oscillating planetary gear type speed reducer using the same.

BACKGROUND ART

A speed reducer is internally composed of sliding parts and rolling parts. When torque is applied to the input side, the speed reducer reduces the speed and transmits high torque to the output side. Such speed reducers are widely used in the field of transportation such as railways, airplanes, and ships as well as in the field of industry such as robots.

One of the features required of a speed reducer is that no lubricant leakage occurs. The speed reducer is provided with a seal for sealing the lubricant, and lubricant leakage is caused because lubricant-insoluble matter (sludge) produced by the deterioration of the lubricant is accumulated in the vicinity of the seal. Therefore, it is required that the amount of sludge produced from the lubricant be small.

Another required feature of the speed reducer is a high efficiency. To date, lubricating oils or greases blended with a calcium salt in a molybdenum dithiocarbamate have been proposed (for example, Patent Literature 1).

Still another required feature of the speed reducer is that the speed reducer can be used in cold regions and the like with the expansion of its use environment. There is a problem in cold regions and the like that the input side torque (starting torque) increases at low temperature as in the winter season. Thus, there is a demand for reduction of input torque at low temperature.

CITATION LIST

Patent Literatures

Patent Literature 1: Japanese Patent Application Publication No. 2004-339411

SUMMARY OF INVENTION

Problems to be Solved by the Invention

Therefore, an object of the present invention is to provide a lubricant composition for an eccentric oscillating planetary gear type speed reducer which produces the same or smaller amount of sludge, which requires a lower input torque at low temperature, and which has the same or higher starting efficiency than a conventional lubricant for an eccentric oscillating planetary gear type speed reducer.

Another object of the present invention is to provide an eccentric oscillating planetary gear type speed reducer having a high starting efficiency, in which lubricant leakage is unlikely to occur and the input torque at low temperature is low.

Means for Solution of the Problems

The present invention provides the following lubricant composition and speed reducer sealing the composition therein.

1. A lubricant composition for an eccentric oscillating planetary gear type speed reducer, comprising the following components (a) to (d):

(a) a base oil containing a synthetic oil;

(b) at least one calcium salt selected from the group consisting of calcium salts of petroleum sulfonic acids, calcium salts of alkyl aromatic sulfonic acids, calcium salts of salicylates, calcium salts of phenates, calcium salts of oxidized waxes, overbased calcium salts of petroleum sulfonic acids, overbased calcium salts of alkyl aromatic sulfonic acids, overbased calcium salts of salicylates, overbased calcium salts of phenates, and overbased calcium salts of oxidized waxes;

(c) an antioxidant; and (d) a glycerin fatty acid ester.

2. The lubricant composition for a speed reducer according to 1 described above, wherein a content of the (b) calcium salt is 0.05 to 5% by mass, a content of the (c) antioxidant is 0.05 to 5% by mass, and a content of the (d) glycerin fatty acid ester is 0.05 to 5% by mass based on a total mass of the lubricant composition.

3. The lubricant composition for a speed reducer according to 1 or 2 described above, wherein the (b) calcium salt is selected from the group consisting of calcium salts of alkyl aromatic sulfonic acids and overbased calcium salts of salicylates.

4. The lubricant composition for a speed reducer according to any one of 1 to 3 described above, wherein the (c) antioxidant is a hindered phenol.

5. The lubricant composition for a speed reducer according to any one of 1 to 4 described above, wherein the synthetic oil in the (a) base oil is a synthetic hydrocarbon oil, and a kinematic viscosity at 40° C. of the base oil is 20 to 300 $mm^2/s$.

6. The lubricant composition for a speed reducer according to any one of 1 to 5 described above, further comprising (e) a thiadiazole compound, wherein a content of the thiadiazole compound is 5% by mass or less based on a total mass of the lubricant composition.

7. An eccentric oscillating planetary gear type speed reducer, wherein the lubricant composition for a speed reducer according to any one of 1 to 6 described above is sealed.

Advantageous Effects of Invention

The lubricant composition for a speed reducer of the invention can reduce the amount of produced sludge to an amount equal to or smaller than that of a conventional lubricant composition for a speed reducer. The lubricant composition of the invention can also reduce the amount of produced sludge accumulated (accumulated particularly near the seal) to an equal or smaller amount. Therefore, the speed reducer of the invention sealing the composition therein is unlikely to cause lubricant leakage. In addition, the lubricant composition for a speed reducer of the invention can suppress the increase in input torque at low temperature. Therefore, the speed reducer of the invention sealing the composition therein can preferably be used also in cold regions and the like. Moreover, the lubricant composition for a speed reducer of the invention can improve the starting efficiency of the speed reducer to a degree equal to or greater than that of a conventional lubricant composition for a speed reducer.

DESCRIPTION OF EMBODIMENTS

<(a) Base Oil>

The (a) base oil used in the invention contains a synthetic oil as an essential component, and may further contain a different base oil such as a mineral oil. As the synthetic oil, it is possible to use any synthetic oil usually used in a lubricant composition, such as a synthetic hydrocarbon oil, an ester oil, a phenyl ether, or a polyglycol. The synthetic oil may be used singly or in combination of two or more kinds.

Specifically, the synthetic hydrocarbon oil includes one obtained by mixing and polymerizing one or two or more kinds of α-olefins. The α-olefin includes an α-olefin produced by using ethylene, propylene, butene, or a derivative thereof as a raw material, and is preferably an α-olefin having 6 to 18 carbon atoms (for example, 1-desen, 1-dodesen, or the like). The most preferable synthetic hydrocarbon oil is a poly-α-olefin (PAO) which is an oligomer of 1-desen or 1-dodesen.

The ester oil includes a monoester, a diester, a polyol ester, a complex ester, or the like.

The phenyl ether includes an alkyl diphenyl ether or the like.

The polyglycol includes a polyalkylene glycol or the like.

The base oil is preferably a base oil containing a synthetic hydrocarbon oil (for example, PAO) and is more preferably the combination of a synthetic hydrocarbon oil (for example, PAO) and a mineral oil.

The percentage of the synthetic oil in the base oil (for example, a synthetic hydrocarbon oil such as PAO) is preferably 10 to 100% by mass, more preferably 10 to 50% by mass, and more preferably 10 to 30% by mass. The percentage of the synthetic oil in the base oil is preferably 10% by mass or more because it is possible to suppress the increase in input torque even at low temperature.

The percentage of the base oil in the lubricant composition of the invention is preferably 80 to 99.5% by mass and more preferably 90 to 99% by mass. The percentage of the base oil in the lubricant composition is preferably in such a range because it is possible to obtain a sufficient lubricating effect without loss of fluidity.

The kinematic viscosity at 40° C. of the base oil used in the invention is, for example, 20 to 300 $mm^2/s$, preferably 30 to 220 $mm^2/s$, more preferably 50 to 200 $mm^2/s$, further preferably 100 to 200 $mm^2/s$, and particularly preferably 135 to 200 $mm^2/s$. It is possible to achieve a satisfactory speed reducer lifetime even at high temperature if the kinematic viscosity is 20 $mm^2/s$ or more, while it is possible to prevent a failure from occurring in the speed reducer on activation at low temperature if the kinematic viscosity is 300 $mm^2/s$ or less. Note that the kinematic viscosity at 40° C. is measured by a method in accordance with JIS K 2283.

<(b) Calcium Salt>

The (b) calcium salt used in the invention is at least one selected from the group consisting of calcium salts of petroleum sulfonic acids, calcium salts of alkyl aromatic sulfonic acids, calcium salts of salicylates (calcium salts of alkyl salicylic acids), calcium salts of phenates (calcium salts of alkyl phenols and calcium salts of sulfurized alkyl phenols), calcium salts of oxidized waxes, overbased calcium salts of petroleum sulfonic acids, overbased calcium salts of alkyl aromatic sulfonic acids, overbased calcium salts of salicylates, overbased calcium salts of phenates, and overbased calcium salts of oxidized waxes. The calcium salt may be used singly or in combination of two or more kinds. These calcium salts can act as a detergent-dispersant, solubilize the sludge to reduce the amount of sludge produced, and moreover improve the efficiency of the speed reducer.

Note that, in the present specification, an "overbased calcium salt of X" means a calcium salt of X whose base number measured in accordance with JIS K 2501 is 200 mg KOH/g or more. A "calcium salt of X" means a calcium salt other than an overbased calcium salt (neutral or basic calcium salt), that is, a calcium salt of X whose base number measured in accordance with JIS K 2501 is less than 200 mg KOH/g. When simply described as "calcium salt," it may be neutral, basic, or overbased.

The (b) calcium salt is preferably at least one selected from the group consisting of calcium salts of alkyl aromatic sulfonic acids and overbased calcium salts of salicylates, and more preferably the combination of a calcium salt of an alkyl aromatic sulfonic acid and an overbased calcium salt of a salicylate. The combination of a calcium salt of an alkyl aromatic sulfonic acid having a base number of 0.1 to 100 mg KOH/g and an overbased calcium salt of a salicylate having a base number of 200 to 500 mg KOH/g is particularly preferable.

The amount of the (b) calcium salt in the lubricant composition is preferably 0.05 to 5% by mass and more preferably 0.1 to 3% by mass. If the amount is 0.05% by mass or more, it is possible to sufficiently suppress the accumulation of the produced sludge. Meanwhile, even if the amount exceeds 5% by mass, it is unlikely that the effect is further improved.

<(c) Antioxidant>

The lubricant composition of the invention contains an antioxidant and thus can suppress the production of sludge generated due to the deterioration of the base oil and the additives. The (c) antioxidant usable in the invention can include, but is not particularly limited to, phenol antioxidants [for example, benzenepropanoic acid 3,5-bis(1,1-dimethyl-ethyl)-4-hydroxy-,C7-C9 side chain alkyl ester, 2,4-dimethyl-6-tertiary-butylphenol, 2,6-di-tertiary butyl-phenol, octadecyl 3-(3,5-di-tert-butyl-4-hydroxyphenyl) propionate, tertiary butyl hydroxyanisole, 2,6-di-tert-butyl-4-methylphenol, thiodiethylene bis[3-(3,5-di-tert-butyl-4-hydroxyphenyl)propionate], hindered phenol compounds such as 2,6-di-t-butyl-p-cresol and pentaerythritol-tetrakis [3-(3,5-di-t-butyl-4-hydroxyphenyl)propionate]], amine antioxidants [for example, aromatic amine compounds such as diphenylamine, phenyl-α-naphthylamine, phenothiazine, and alkylated products thereof], and the like. Phenol antioxidants are preferable and hindered phenols are more preferable. The hindered phenols have a melting point of preferably 100° C. or less and more preferably 50° C. or less from the viewpoint of solubility to the base oil. Specifically, preferable examples include benzenepropanoic acid 3,5-bis (1,1-dimethyl-ethyl)-4-hydroxy-,C7-C9 side chain alkyl ester (liquid at 25° C.), 2,4-dimethyl-6-tertiary-butylphenol (liquid at 25° C.), 2,6-di-tertiary butyl-phenol (35 to 37° C.), octadecyl 3-(3,5-di-tert-butyl-4-hydroxyphenyl)propionate (49 to 54° C.), tertiary butyl hydroxyanisole (59 to 65° C.), 2,6-di-tert-butyl-4-methylphenol (70° C.), and thiodiethylene bis[3-(3,5-di-tert-butyl-4-hydroxyphenyl)propionate] (70° C.) (melting point in the parentheses). Note that the melting point of the phenol antioxidant is measured by a method in accordance with JIS K 0064. The antioxidant may be used singly or in combination of two or more kinds.

The amount of the (C) antioxidant in the lubricant composition is preferably 0.05 to 5% by mass and more preferably 0.1 to 3% by mass. If the amount is 0.05% by mass or more, it is possible to effectively suppress the production of sludge. Meanwhile, even if the amount exceeds 5% by mass, it is unlikely that the effect is further improved.

<(d) Glycerin Fatty Acid Ester>

The lubricant composition of the invention contains a glycerin fatty acid ester, and thus forms an adsorption film on the metal surface to reduce friction, making it possible to improve the efficiency of the speed reducer to a degree equal to or greater than that of the conventional technique. The (d) glycerin fatty acid ester usable in the invention is not limited, but has a melting point of preferably 100° C. or less and more preferably 50° C. or less from the viewpoint of solubility to the base oil. Note that the melting point of the glycerin fatty acid ester is measured by a method in accordance with JIS K 0064.

The ester may be a complete ester or a partial ester, but is preferably a partial ester and more preferably a monoester. The fatty acid constituting the ester is preferably a linear or branched saturated or unsaturated fatty acid having 6 to 22 carbon atoms and more preferably a linear saturated fatty acid having 6 to 18 carbon atoms. Specifically, preferable examples of the glycerin fatty acid ester include glycerin monocaprylate (31° C.), glycerin monocaprate (46° C.), glycerin monolaurate (57° C.), glycerin monostearate (63 to 70° C.), glycerin monobehenate (75 to 85° C.), glycerin mono 12 hydroxystearate (70 to 78° C.), and glycerin monooleate (37° C.) (melting point in the parentheses). Among these, glycerin monocaprylate (31° C.) is preferable. The glycerin fatty acid ester may be used singly or in combination of two or more kinds.

The amount of the (d) glycerin fatty acid ester in the lubricant composition is preferably 0.05 to 5% by mass and more preferably 0.1 to 3% by mass. If the amount is 0.05% by mass or more, it is possible to exhibit a sufficient friction reducing effect. Meanwhile, even if the amount exceeds 5% by mass, it is unlikely that the effect is further improved.

<Thickener>

The lubricant composition of the invention may contain a thickener. The thickener includes all thickeners. Examples thereof include soap thickeners such as lithium soaps and complex lithium soaps, urea thickeners such as diurea, inorganic thickeners such as organic clay and silica, organic thickeners such as PTFE, and the like. Preferable ones are lithium soap thickeners and urea thickeners, and more preferable ones are lithium soap thickeners.

The percentage of the thickener in the lubricant composition is preferably 0 to 20% by mass (for example, 1 to 15% by mass) and further preferably 0.5 to 10% by mass (for example, 0.5 to 3% by mass). If the percentage is 0.5% by mass or more, the thickening effect is exhibited. If the percentage is 20% by mass or less, it is possible to obtain a sufficient lubricating effect because the thickener becomes a grease of moderate consistency which allows the lubricant to spread throughout the lubrication sites.

If the lubricant composition contains a thickener, the cone penetration of the lubricant composition is preferably 300 to 450 (for example, 350 to 410) and more preferably 395 to 425. Note that, as defined in JIS K 2220, the cone penetration is a value measured immediately after the sample is worked for 60 strokes with a specified working machine.

<Additive>

The lubricant composition of the invention can be added with various types of additives as needed. Such additives include metal salt rust inhibitors other than the component (b), metal salt detergent-dispersants other than the component (b), antioxidants other than the component (c), oiliness agents, metal corrosion inhibitors, antiwear agents, extreme pressure agents ("EP agent"), and solid lubricants other than the component (d), and the like. Among these, extreme pressure agents are preferable.

The extreme pressure agent which may be used in the invention is not particularly limited, and preferably contains at least one selected from, for example, molybdenum dithiocarbamates, trioctyl phosphates, and ashless dithiocarbamates. It is further preferable to use (e) a thiadiazole compound in combination. A preferable example of the molybdenum dithiocarbamate is one represented by the following formula:

$$(R^1R^2N—CS—S)_2—Mo_2O_mS_n$$

wherein $R^1$ and $R^2$ each independently represent an alkyl group having 5 to 24 carbon atoms, m is 0 to 3, n is 4 to 1, and m+n=4.

The thiadiazole compound includes a 1,2,4-thiadiazole derivative, a 1,3,4-thiadiazole derivative, a 1,2,5-thiadiazole derivative, or a 1,4,5-thiadiazole derivative, and is preferably a 1,3,4-thiadiazole derivative. A preferable example of the 1,3,4-thiadiazole derivative is one represented by the following formula

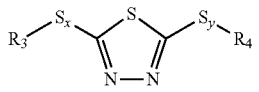

wherein $R_3$ and $R_4$ each independently represent a hydrogen atom or a linear or branched alkyl group or alkenyl group having 1 to 20 carbon atoms, and x and y are each 0 to 2.

If an extreme pressure agent is contained, a reaction film is formed on the metal surface to reduce friction and wear, making it possible to improve the efficiency of the speed reducer and the speed reducer lifetime at high temperature. If the lubricant composition of the invention contains an extreme pressure agent, the amount of the extreme pressure agent in the lubricant composition is preferably 5% by mass or less, more preferably 3% by mass or less, and further preferably 0.1 to 3% by mass. The extreme pressure agent in an amount of 5% by mass or less makes it possible to improve the lubricating lifetime at high temperature and the efficiency of the speed reducer while suppressing the production of sludge derived from the additives. In particular, the amount of the molybdenum dithiocarbamate is preferably 0.1 to 2% by mass and further preferably 0.1 to 1.5% by mass.

The invention will be more specifically described with reference to Examples below.

EXAMPLES

The components presented in Table 1 and Table 2 were mixed at the percentages presented in Table 1 and Table 2 to prepare lubricant compositions of Examples and Comparative Examples. These lubricant compositions were tested under the following conditions. Table 1 and Table 2 present the results.

Evaluation of Low Temperature Torque of Speed Reducer (Low Temperature Property)

A speed reducer was used to carry out a test under the following conditions, in which the torque of the input shaft required to rotate the speed reducer without load was read to measure the input torque at low temperature.

<Test Conditions> model number of the speed reducer: RV-42N3-127.15 test temperature: −10° C.

load torque [load in the radial direction (direction perpendicular to the shaft direction)): no load output rotational speed: 15.7 rpm <Acceptableness Determination>

Determination was made using the relative torque ratio with the torque of Comparative Example 1 set to 1.

The relative torque ratio is 0.5 (−10° C.) or less ○ (acceptable)

The relative torque ratio exceeds 0.5 (−10° C.) x (unacceptable)

Sludge Resistance (RBOT Test)

An RBOT test machine in accordance with JIS K 2514 3. was used to carry out a test under the following conditions. The insoluble matter produced after the test was filtered while being washed with hexane and quantified as sludge.

<Test Conditions> test temperature: 150° C.

test time: 24 h

<Acceptableness Determination>

Evaluation was conducted using the relative ratio with the amount of sludge of Comparative Example 1 set to 1.0.

The sludge amount ratio is 1.2 or less ○ (acceptable)

The sludge amount ratio exceeds 1.2 x (unacceptable)

Evaluation of Starting Efficiency of Speed Reducer

A speed reducer was used to carry out a test under the following conditions, in which the starting efficiency (actual output torque with the output torque outputted 100% with respect to the torque of the input shaft (theoretical value) set to 100) was measured.

<Test Conditions> model number of the speed reducer: RV-42N3-127.15 test temperature: 25° C.

load torque [load in the radial direction (direction perpendicular to the shaft direction)): 42 kgf-m <Acceptableness Determination>

Evaluation was conducted using the relative efficiency ratio with the efficiency of Comparative Example 1 set to 1.0.

The relative efficiency is 1.0 or more ○ (acceptable)

The relative efficiency is less than 1.0 x (unacceptable)

<Comprehensive Determination>

All of the low temperature property, sludge resistance, and starting efficiency are acceptable ○ (acceptable)

One or more of them are unacceptable x (unacceptable)

Details of the (b) calcium salt, the (c) antioxidant, the (d) glycerin fatty acid ester, the (e) thiadiazole compound, and the extreme pressure agent in Table 1 and Table 2 are as follows.

(b) Calcium Salt

Ca sulfonate: calcium salt of an alkyl aromatic sulfonic acid (manufactured by KING INDUSTRIES, Inc., trade name: NA-SUL729, base number of 1 mg KOH/g)

Ca salicylate: overbased calcium salt of a salicylate (manufactured by Osuka Kagaku, trade name: OSCA 438B, base number of 320 mg KOH/g)

(c) Antioxidant hindered phenol (manufactured by BASF Japan, trade name: IRGANOX L135, liquid at 25° C.)

(d) Glycerin Fatty Acid Ester glycerin monocaprylate (Riken Vitamin Co., Ltd., trade name: POEM M-100, melting point of 31° C.)

(e) Extreme Pressure Agent thiadiazole compound A (manufactured by DIC Corporation, trade name: DAILUBE R-300)

thiadiazole compound B (manufactured by Afton Chemical Corporation, trade name: HITEC 4313)

thiadiazole compound C (manufactured by R. T. VANDERBILT, trade name: CUVAN 826)

MoDTC: molybdenum dialkyl dithiocarbamate (manufactured by ADEKA Corporation, trade name ADEKA SAKURA-LUBE 525)

TOP: trioctyl phosphate (manufactured by Daihachi Chemical Industry Co., Ltd., trade name: TOP)

ashless DTC: ashless dithiocarbamate (manufactured by R. T. VANDERBILT, trade name: Vanlube 7723)

As presented in Table 1 and Table 2, the lubricant compositions of Examples 1 to 25 of the invention have a better low temperature property than Comparative Example 1 not containing a synthetic hydrocarbon oil in the base oil, and have a better sludge resistance than Comparative Example 2 not containing a calcium salt in the additives and Comparative Example 3 not containing an antioxidant. In addition, the lubricant compositions of Examples 1 to 11 of the invention have a better starting efficiency than Comparative Example 4 not containing a glycerin fatty acid ester.

It is understood that Example 7 using Ca sulfonate and Ca salicylate in combination and Examples 8 to 25 further containing a thiadiazole compound have a further better starting efficiency than Examples 1 to 6.

TABLE 1

| | | | | Example | | | | | | |
|---|---|---|---|---|---|---|---|---|---|---|
| | | | | 1 | 2 | 3 | 4 | 5 | 6 | 7 |
| (a) Base Oil | Mineral Oil | | | 70 | 70 | 70 | 70 | 70 | 70 | 70 |
| (Mass Ratio in | Synthetic Hydrocarbon Oil (PAO) | | | 30 | 30 | 30 | 30 | 30 | 30 | 30 |
| Base Oil) | Kinematic Viscosity @40° C., $mm^2/s$ | | | 150 | 150 | 150 | 150 | 150 | 150 | 150 |
| Additive | (b) Ca Salt | Ca Sulfonate | | — | — | — | — | — | — | 0.2 |
| (Mass % | | Ca Salicylate | | 0.2 | 0.2 | 0.05 | 5 | 0.2 | 0.2 | 0.2 |
| Based on | (c) Antioxidant | | | 0.2 | 0.2 | 0.2 | 0.2 | 0.05 | 5 | 0.2 |
| Total Mass of | (d) Glycerin Fatty Acid Ester | | | 0.2 | 0.2 | 0.2 | 0.2 | 0.2 | 0.2 | 0.2 |
| Composition) | EP Agent | (e) Thiadiazole | A | — | — | — | — | — | — | — |
| | | Compound | B | — | — | — | — | — | — | — |
| | | | C | — | — | — | — | — | — | — |
| | | MoDTC | | 0.5 | 0.5 | 0.5 | 0.5 | 0.5 | 0.5 | 0.5 |
| | | TOP | | — | 0.5 | 0.5 | 0.5 | 0.5 | 0.5 | 0.5 |
| | | Ashless DTC | | — | 0.2 | 0.2 | 0.2 | 0.2 | 0.2 | 0.2 |
| Low Temperature Property | | Result | | 0.5 | 0.5 | 0.5 | 0.5 | 0.5 | 0.5 | 0.5 |
| | | Determination | | ○ | ○ | ○ | ○ | ○ | ○ | ○ |
| Sludge Resistance | | Result | | 1.0 | 1.1 | 1.2 | 1.1 | 1.2 | 1.1 | 1.1 |
| | | Determination | | ○ | ○ | ○ | ○ | ○ | ○ | ○ |

TABLE 1-continued

| | | | | | | | | | |
|---|---|---|---|---|---|---|---|---|---|
| Starting Efficiency | Result | | 1.0 | 1.0 | 1.0 | 1.0 | 1.0 | 1.0 | 1.1 |
| | Determination | | ○ | ○ | ○ | ○ | ○ | ○ | ○ |
| Comprehensive Determination | | | ○ | ○ | ○ | ○ | ○ | ○ | ○ |

| | | | | Example | | | | | |
|---|---|---|---|---|---|---|---|---|---|
| | | | | 8 | 9 | 10 | 11 | 12 | 13 |
| (a) Base Oil | Mineral Oil | | | 70 | 70 | 70 | 70 | 70 | 70 |
| (Mass Ratio in | Synthetic Hydrocarbon Oil (PAO) | | | 30 | 30 | 30 | 30 | 30 | 30 |
| Base Oil) | Kinematic Viscosity @40° C., $mm^2/s$ | | | 150 | 150 | 150 | 150 | 150 | 150 |
| Additive | (b) Ca Salt | Ca Sulfonate | | 0.2 | 0.2 | 0.2 | 0.2 | 0.2 | 0.2 |
| (Mass % | | Ca Salicylate | | 0.2 | 0.2 | 0.2 | 0.2 | 0.2 | 0.2 |
| Based on | (c) Antioxidant | | | 0.2 | 0.2 | 0.2 | 0.2 | 0.2 | 0.2 |
| Total Mass of | (d) Glycerin Fatty Acid Ester | | | 0.2 | 0.2 | 0.2 | 0.2 | 0.2 | 0.2 |
| Composition) | EP Agent | (e) Thiadiazole | A | 0.07 | 0.13 | 0.25 | 0.5 | 1.0 | 1.5 |
| | | Compound | B | — | — | — | — | — | — |
| | | | C | — | — | — | — | — | — |
| | | MoDTC | | 0.5 | 0.5 | 0.5 | 0.5 | 0.5 | 0.5 |
| | | TOP | | 0.5 | 0.5 | 0.5 | 0.5 | 0.5 | 0.5 |
| | | Ashless DTC | | 0.2 | 0.2 | 0.2 | 0.2 | 0.2 | 0.2 |
| Low Temperature Property | | Result | | 0.5 | 0.5 | 0.5 | 0.5 | 0.5 | 0.5 |
| | | Determination | | ○ | ○ | ○ | ○ | ○ | ○ |
| Sludge Resistance | | Result | | 1.1 | 1.1 | 1.1 | 1.1 | 1.2 | 1.2 |
| | | Determination | | ○ | ○ | ○ | ○ | ○ | ○ |
| Starting Efficiency | | Result | | 1.2 | 1.2 | 1.2 | 1.3 | 1.3 | 1.3 |
| | | Determination | | ○ | ○ | ○ | ○ | ○ | ○ |
| Comprehensive Determination | | | | ○ | ○ | ○ | ○ | ○ | ○ |

TABLE 2

| | | | | Example | | | | | | | | |
|---|---|---|---|---|---|---|---|---|---|---|---|---|
| | | | | 14 | 15 | 16 | 17 | 18 | 19 | 20 | 21 | 22 |
| (a) Base Oil | Mineral Oil | | | 70 | 70 | 70 | 70 | 70 | 70 | 70 | 70 | 70 |
| (Mass Ratio in | Synthetic Hydrocarbon Oil (PAO) | | | 30 | 30 | 30 | 30 | 30 | 30 | 30 | 30 | 30 |
| Base Oil) | Kinematic Viscosity @40° C., $mm^2/s$ | | | 150 | 150 | 150 | 150 | 150 | 150 | 150 | 150 | 150 |
| Additive | (b) Ca Salt | Ca Sulfonate | | 0.2 | 0.2 | 0.2 | 0.2 | 0.2 | 0.2 | 0.2 | 0.2 | 0.2 |
| (Mass % | | Ca Salicylate | | 0.2 | 0.2 | 0.2 | 0.2 | 0.2 | 0.2 | 0.2 | 0.2 | 0.2 |
| Based on | (c) Antioxidant | | | 0.2 | 0.2 | 0.2 | 0.2 | 0.2 | 0.2 | 0.2 | 0.2 | 0.2 |
| Total Mass of | (d) Glycerin Fatty Acid Ester | | | 0.2 | 0.2 | 0.2 | 0.2 | 0.2 | 0.2 | 0.2 | 0.2 | 0.2 |
| Composition) | EP Agent | (e) Thiadiazole | A | — | — | — | — | — | — | — | — | — |
| | | Compound | B | 0.07 | 0.13 | 0.25 | 0.5 | 1.0 | 1.5 | — | — | — |
| | | | C | — | — | — | — | — | — | 0.07 | 0.13 | 0.25 |
| | | MoDTC | | 0.5 | 0.5 | 0.5 | 0.5 | 0.5 | 0.5 | 0.5 | 0.5 | 0.5 |
| | | TOP | | 0.5 | 0.5 | 0.5 | 0.5 | 0.5 | 0.5 | 0.5 | 0.5 | 0.5 |
| | | Ashless DTC | | 0.2 | 0.2 | 0.2 | 0.2 | 0.2 | 0.2 | 0.2 | 0.2 | 0.2 |
| Low Temperature Property | | Result | | 0.5 | 0.5 | 0.5 | 0.5 | 0.5 | 0.5 | 0.5 | 0.5 | 0.5 |
| | | Determination | | ○ | ○ | ○ | ○ | ○ | ○ | ○ | ○ | ○ |
| Sludge Resistance | | Result | | 1.1 | 1.1 | 1.1 | 1.1 | 1.2 | 1.2 | 1.1 | 1.1 | 1.1 |
| | | Determination | | ○ | ○ | ○ | ○ | ○ | ○ | ○ | ○ | ○ |
| Starting Efficiency | | Result | | 1.2 | 1.2 | 1.2 | 1.3 | 1.3 | 1.3 | 1.2 | 1.2 | 1.2 |
| | | Determination | | ○ | ○ | ○ | ○ | ○ | ○ | ○ | ○ | ○ |
| Comprehensive Determination | | | | ○ | ○ | ○ | ○ | ○ | ○ | ○ | ○ | ○ |

| | | | | Example | | | Comparative Example | | | |
|---|---|---|---|---|---|---|---|---|---|---|
| | | | | 23 | 24 | 25 | 1 | 2 | 3 | 4 |
| (a) Base Oil | Mineral Oil | | | 70 | 70 | 70 | 100 | 70 | 70 | 70 |
| (Mass Ratio in | Synthetic Hydrocarbon Oil (PAO) | | | 30 | 30 | 30 | — | 30 | 30 | 30 |
| Base Oil) | Kinematic Viscosity @40° C., $mm^2/s$ | | | 150 | 150 | 150 | 150 | 150 | 150 | 150 |
| Additive | (b) Ca Salt | Ca Sulfonate | | 0.2 | 0.2 | 0.2 | — | — | — | — |
| (Mass % | | Ca Salicylate | | 0.2 | 0.2 | 0.2 | 0.2 | — | 0.2 | 0.2 |
| Based on | (c) Antioxidant | | | 0.2 | 0.2 | 0.2 | 0.2 | 0.2 | — | 0.2 |
| Total Mass of | (d) Glycerin Fatty Acid Ester | | | 0.2 | 0.2 | 0.2 | 0.2 | 0.2 | 0.2 | — |
| Composition) | EP Agent | (e) Thiadiazole | A | — | — | — | — | — | — | — |
| | | Compound | B | — | — | — | — | — | — | — |
| | | | C | 0.5 | 1.0 | 1.5 | — | — | — | — |
| | | MoDTC | | 0.5 | 0.5 | 0.5 | 0.5 | 0.5 | 0.5 | 0.5 |
| | | TOP | | 0.5 | 0.5 | 0.5 | 0.5 | 0.5 | 0.5 | 0.5 |
| | | Ashless DTC | | 0.2 | 0.2 | 0.2 | 0.2 | 0.2 | 0.2 | 0.2 |
| Low Temperature Property | | Result | | 0.5 | 0.5 | 0.5 | 1.0 | 0.5 | 0.5 | 0.5 |
| | | Determination | | ○ | ○ | ○ | — | ○ | ○ | ○ |

TABLE 2-continued

| | | | | | | | | |
|---|---|---|---|---|---|---|---|---|
| Sludge Resistance | Result | 1.1 | 1.2 | 1.2 | 1.0 | 1.4 | 1.4 | 1.1 |
| | Determination | ○ | ○ | ○ | — | x | x | ○ |
| Starting Efficiency | Result | 1.3 | 1.3 | 1.3 | 1.0 | 1.0 | 1.0 | 0.9 |
| | Determination | ○ | ○ | ○ | — | ○ | ○ | x |
| Comprehensive Determination | | ○ | ○ | ○ | — | x | x | x |

What is claimed is:

1. A lubricant composition for an eccentric oscillating planetary gear type speed reducer, consisting of the following components (a) to (e):

(a) a base oil containing a synthetic oil;

(b) at least one calcium salt selected from the group consisting of calcium salts of petroleum sulfonic acids, calcium salts of alkyl aromatic sulfonic acids, calcium salts of salicylates, calcium salts of phenates, calcium salts of oxidized waxes, overbased calcium salts of petroleum sulfonic acids, overbased calcium salts of alkyl aromatic sulfonic acids, overbased calcium salts of salicylates, overbased calcium salts of phenates, and overbased calcium salts of oxidized waxes;

(c) an antioxidant;

(d) a glycerin fatty acid ester; and (e) an optional additive selected from the group consisting of metal salt rust inhibitors other than the component (b), metal salt detergent-dispersants other than the component (b), antioxidants other than the component (c), metal corrosion inhibitors, antiwear agents, extreme pressure agents, and solid lubricants other than the component (d).

2. The lubricant composition for a speed reducer according to claim 1, wherein a content of the (b) calcium salt is 0.05 to 5% by mass, a content of the (c) antioxidant is 0.05 to 5% by mass, and a content of the (d) glycerin fatty acid ester is 0.05 to 5% by mass based on a total mass of the lubricant composition.

3. The lubricant composition for a speed reducer according to claim 1, wherein the (b) calcium salt is selected from the group consisting of calcium salts of alkyl aromatic sulfonic acids and overbased calcium salts of salicylates.

4. The lubricant composition for a speed reducer according to claim 1, wherein the (c) antioxidant is a hindered phenol.

5. The lubricant composition for a speed reducer according to claim 1, wherein the synthetic oil in the (a) base oil is a synthetic hydrocarbon oil, and a kinematic viscosity at 40° C. of the base oil is 20 to 300 $mm^2/s$.

6. The lubricant composition for a speed reducer according to claim 1, further comprising (e) a thiadiazole compound, wherein a content of the thiadiazole compound is 5% by mass or less based on a total mass of the lubricant composition.

7. An eccentric oscillating planetary gear type speed reducer, wherein the lubricant composition for a speed reducer according to claim 1 is sealed.

* * * * *